United States Patent [19]

Henshaw

[11] 4,353,158

[45] Oct. 12, 1982

[54] METHOD FOR CONVERTING A LOCKSTITCH SEWING MACHINE TO A MACHINE FOR DECORATING FABRICS

[75] Inventor: David E. Henshaw, Belmont, Australia

[73] Assignee: I.W.S. Nominee Company Limited, Ilkley, England

[21] Appl. No.: 247,771

[22] Filed: Mar. 26, 1981

Related U.S. Application Data

[63] Continuation of Ser. No. 969,248, Dec. 13, 1978, abandoned.

[30] Foreign Application Priority Data

Dec. 16, 1977 [GB] United Kingdom ..... 52391/77

[51] Int. Cl.[3] ..... B23P 23/00; B23P 17/04; B21K 21/16; D04H 18/00

[52] U.S. Cl. ..... 29/401.1; 28/109; 112/152; 112/168; 206/223; 206/574

[58] Field of Search ..... 29/401.1; 206/223, 574; 28/109, 115, 164; 112/152, 168

[56] References Cited

U.S. PATENT DOCUMENTS

| | | | |
|---|---|---|---|
| 152,662 | 6/1874 | Manning | 112/152 X |
| 249,571 | 11/1881 | Baker | 112/152 X |
| 1,124,735 | 1/1915 | Hayes et al. | 112/152 |
| 1,747,749 | 2/1930 | Yerkes | 112/152 |
| 3,243,861 | 4/1966 | Kumin et al. | 28/109 |
| 3,681,823 | 8/1972 | Dilo | 28/109 |
| 3,703,752 | 11/1972 | Schulte | 28/109 |
| 3,765,350 | 10/1973 | Sztari | 112/122 |
| 3,847,099 | 11/1974 | Braun | 112/152 |
| 3,894,320 | 7/1975 | Lauman et al. | 28/109 |

FOREIGN PATENT DOCUMENTS

| | | | |
|---|---|---|---|
| 1913128 | 10/1969 | Fed. Rep. of Germany | 28/109 |
| 423998 | 2/1935 | United Kingdom . | |
| 1200051 | 7/1970 | United Kingdom | 112/152 |

*Primary Examiner*—Robert Mackey

*Attorney, Agent, or Firm*—Kerkam, Stowell, Kondracki & Clarke

[57] ABSTRACT

A method is disclosed for converting a lockstitch sewing machine to a machine for decorating fabrics with at least one untwisted strand of keratinous fiber applied in a pattern to the fabric. In general, the method consists of removing the throat plate, feed dog, presser foot, bobbin, bobbin case and needle bar from the lockstitch sewing machine and inserting instead a needle block having means for securing a plurality of standard punching needles therein, a throat plate apertured to correspond with the plural punching needles carried by the needle block, a presser foot apertured to correspond with the spacing of the needles in the needle block whether passage of the punching needles therethrough and a presser foot with a guide passage for the fibrous strand and a feeddog with sufficient clearance for the punching needles carried by the needle block.

3 Claims, 6 Drawing Figures

METHOD FOR CONVERTING A LOCKSTITCH SEWING MACHINE TO A MACHINE FOR DECORATING FABRICS

This application is a continuation of application Ser. No. 969,248, filed 12-13-78, now abandoned.

This invention relates to apparatus for and a method of decorating fabrics, and to the decorated fabrics so produced.

In the textile field the decoration of fabrics is of major importance. The appearance, that is colour, texture and pattern or design, of textile goods is a principal factor in their acceptability, and therefore a great influence in the sale of such goods. Many methods of making attractive and aesthetically pleasing fabrics are known, and new methods are always being sought. Known methods range from dyeing or printing of fabrics, through inclusion of different coloured yarns during fabric formation by patterning means such as Jacquard systems, to the introduction of textured or "fancy" yarns.

It is of advantage to be able to leave patterning to a late stage in fabric production, and especially to the garment stage, because design decisions can then be taken as late as possible and large stocks of patterned fabrics need not be maintained.

The present invention accordingly seeks to provide means whereby decorative patterns can be produced batch-wise on small pieces of fabric or more especially on made-up garments.

Fabrics according to this invention are characterized by a decorative pattern comprising at least one fibrous nep, strand or web consolidated into the basic fabric in a predetermined area by needle punching.

The method of producing such decorated fabrics according to the invention comprises applying at least one fibrous nep, strand or web to a predetermined area of a base fabric and consolidating it into the surface of the fabric by needle punching in the said area.

In preferred embodiments of the method, the decorative fibers are punched through the base fabric by needles operating on the reverse side of the fabric.

Further in accordance with the present invention, there is provided apparatus for decorating fabrics which comprises an assembly of needles arranged for reciprocation into and out of a working zone, means for controlling and moving a fabric in the working zone and a feeder or feeders for supplying at least one fibrous strand to a predetermined area of the fabric within the working zone.

Although it is possible for the base fabric to be needled over its whole area, the preferred embodiments of the invention confine the needling to a restricted area encompassing the area of the pattern. Such localised needling is particularly suited to the application of decorative fibers to garments or garment pieces at a very late stage in production, with the advantages already indicated.

For localized needling, the present invention provides a preferred form of apparatus which comprises a block of needles of restricted area reciprocable into and out of a working zone, a fabric support to support fabric for passage through the working zone, means for controlling and moving the fabric in the working zone and at least one feeder for supplying at least one fibrous strand to a predetermined area of the fabric for consolidation to form a pattern therein.

It is to be understood that the block of needles should be small in relation to the dimensions of the fabric and is preferably only large enough to needle one strand or a small number of strands to the base fabric at one time.

The needles used may be any standard needle-punching needles, for example 15-18-36 CB Standard, 15-18-32 RB Type A Kick-up or 15-18-32 RB No Kick-up Ball Point. The number mounted in the block may vary within wide limits, for instance, from 3 to 40, with about 10 being suitable for most purposes.

The means for controlling and moving the base fabric in the working zone may include any suitable mechanized arrangement such as a roller or rollers, but preferably comprises a presser plate and feed dogs.

Conveniently, the apparatus of the invention may be based upon a modified sewing machine, in which the needle block replaces the sewing needle and additional feeders are provided to supply the fibrous strands. In this case, the bobbin and underbed components are removed, and the normal presser foot replaced with one having a number of holes therein, corresponding to the needles in the block, and a guide to lead the fibrous strand or strands under the foot to the working zone. The throat plate should be modified to receive the needles and the feed dogs should have sufficient clearance to avoid interference with the needles. Advantageously, a dense bristle bed, or preferably a plate with holes corresponding to the needle array, may be mounted flush with the throat plate in the working zone to support the fabric during needling. The fabric or garment to be decorated may be of any construction, e.g. knitted, woven or non-woven, although the invention may be found to be primarily used to decorate knitted fabrics and especially knitted garments. The decorative textile fibers may be in the form of one or more yarns, rovings, slivers or slubbings.

The textile fibers may be the same as or different from the fibers of the fabric being decorated, and either may be chosen from natural or synthetic textile fibers, for example polyamides, polyesters, acrylics, vinyl, ethylenically unsaturated fibers, regenerated cellulosics, natural cellulosics and especially keratinous fibers such as wool.

In order to improve the appearance of the decorated fabric, it is desirable to give it a milling treatment. This has the effect of consolidating the textile fibers and causing them to blend in better with the fabric surface. Since only keratinous fibers mill successfully, it is especially preferred that this class of fiber be used, ideally for both the fabric and the textile fiber decoration, but particularly for the latter.

By using the invention, a wide variety of designs and patterned effects can be introduced into the base fabric, including horizontal, vertical or diagonal stripes or combinations thereof, wavy lines, whorls or other patterns depending only on the skill of the operator.

When introducing wool slivers or rovings, these may be given a mild shrink resist treatment, e.g. chlorination with dichlorocyanuric acid (D.C.C.A.), in order to reduce their potential shrinkage during milling and so prevent puckering of the base fabric. Moreover, to reduce needle damage to the base fabric, it may be lubricated, e.g. with wax.

The invention will be described further, by way of example, with reference to the accompanying drawings, in which the same reference numerals are used to indicate similar parts.

Figure 1:
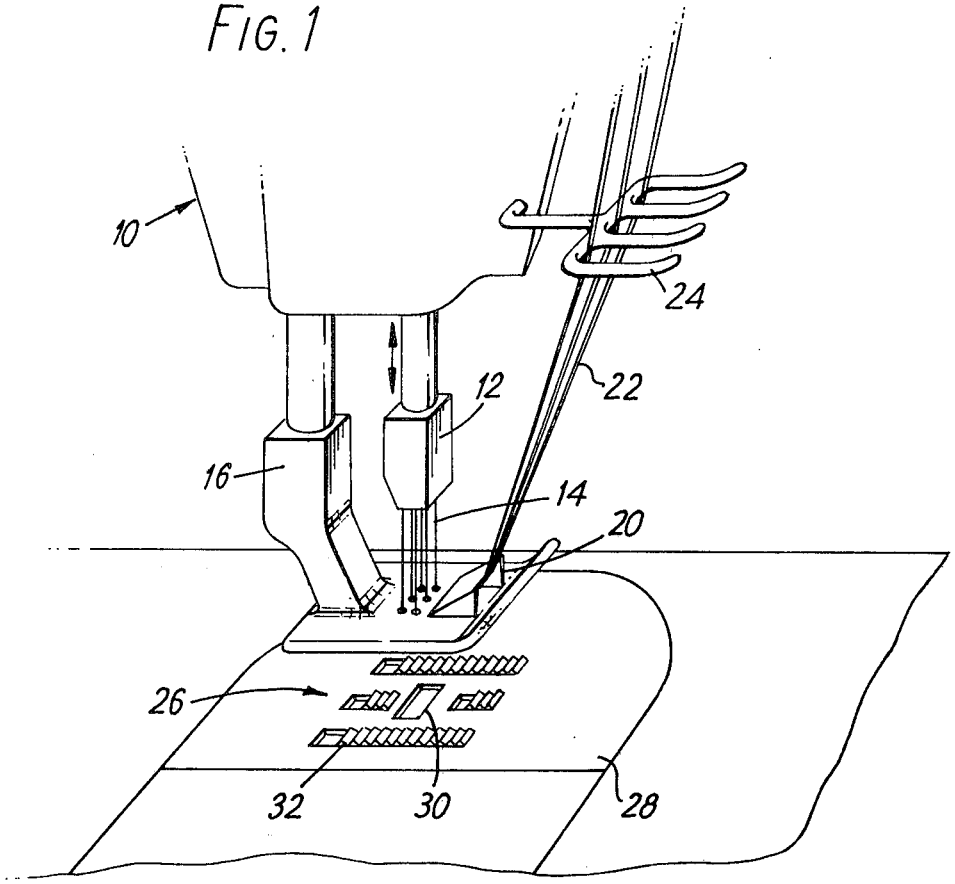
FIG. 1 is a perspective view of one form of apparatus according to the invention.

As shown in FIG. 1 a standard lockstitch sewing machine 10 is modified by the removal of its sewing needle and the substitution of a block 12 carrying needle-punching needles 14. A modified presser foot 16 has holes 18 corresponding to each of the needles 14 and a guide orifice 20 for receiving slivers 22. A feeder 24 capable of receiving slivers 22 is mounted on the machine 10 above the working zone 26.

The throat plate 28 of the machine 20 is adapted to receive the needles 14 by the provision of a suitable aperture 30. The underbed components and bobbin are removed. The throat plate 28 has driven feed dogs 32 which move the fabric (not shown) through the working zone 26 when the presser foot 16 is lowered.

The manner of operating the apparatus is similar to that for a conventional sewing machine, with the fabric being guided through the working zone 26, into which the needles 14 reciprocate, by manual guidance in association with the feed dogs 32. The pattern is made by the operator guiding the fabric along the desired path.

Figure 2:
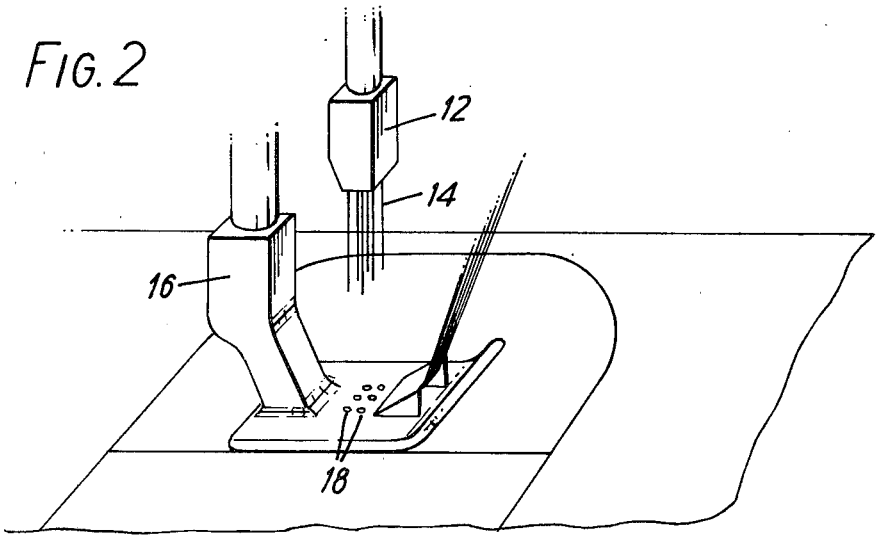
FIG. 2 is a similar view to FIG. 1 with the presser foot lowered.
Figure 3:
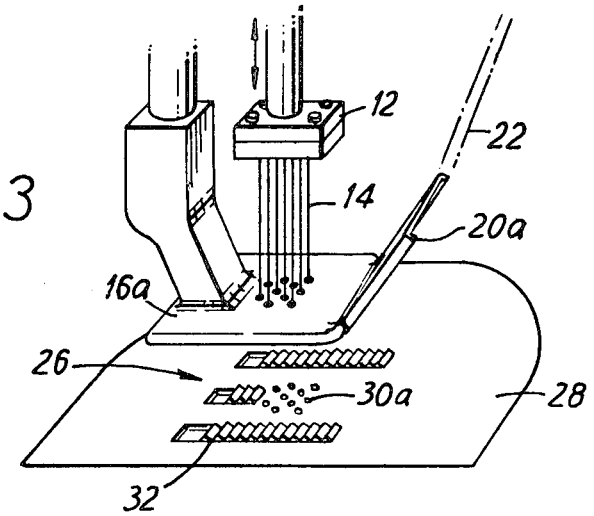
FIG. 3 is a view similar to FIG. 1 of a second form of apparatus of this invention.

In FIG. 3 is shown a preferred modification of a sewing machine similar to that of FIGS. 1 and 2. In this form of apparatus, the block 12, of modified form carries ten needles 14 and the presser foot 16 is formed with an edgemounted guide **20*a* for an incoming roving 22. The throat plate 28 is formed with ten individual apertures 30*a*** to receive the respective needles and the front feed dogs are omitted.

Figure 4:
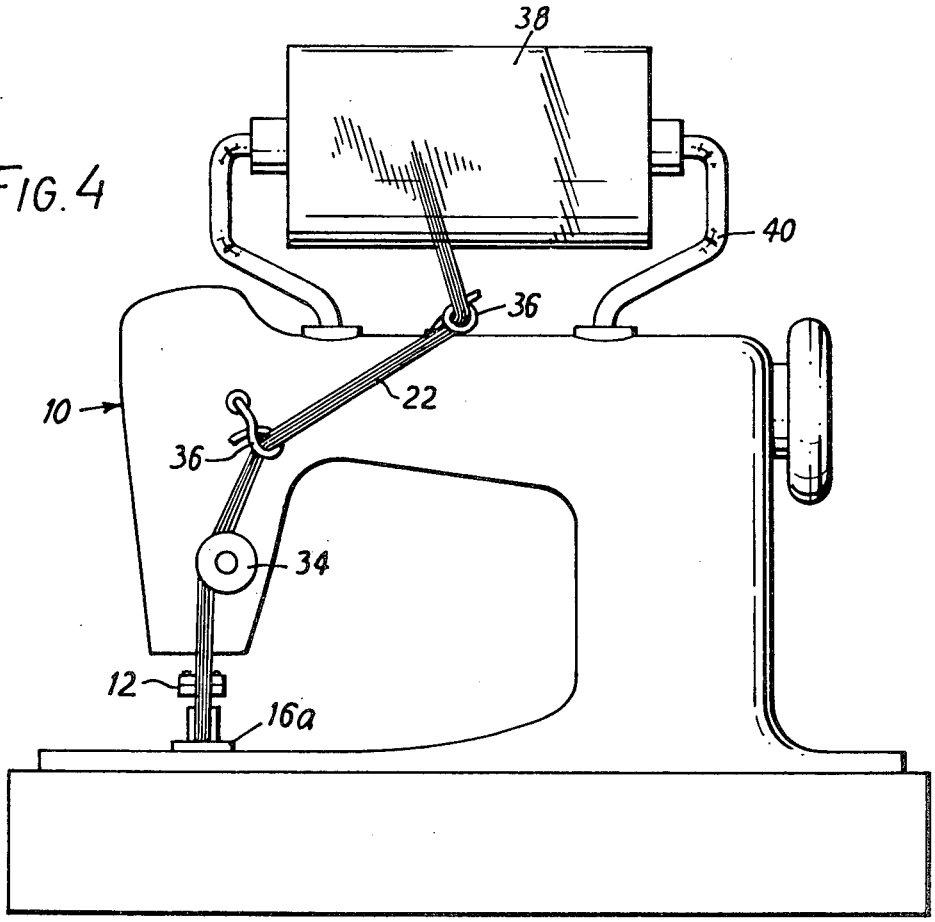
FIG. 4 is a general side view of a sewing machine modified by the inclusion of the apparatus of FIG. 3.

The sewing machine 10 in FIG. 4 is fitted with a modified presser foot **16*a* and throat plate as shown in FIG. 3. A roving tensioner 34 is fitted in the conventional position for the thread tensioner, and open loop eyes 36 guide the roving from a package 38 mounted above the machine on a spring mounting 40**.

Figure 5A:
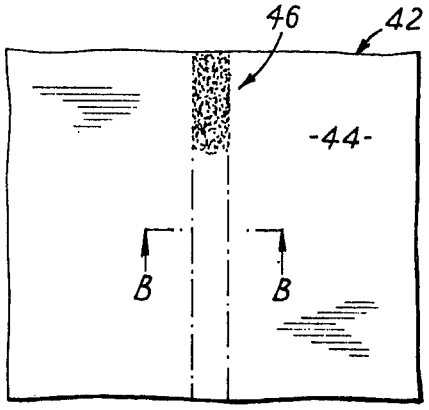
FIGS. 5A and 5B are views of a fabric decorated in accordance with the invention, FIG. 5B being a diagrammetic cross-section (not to scale) along the line B—B in FIG. 5A.
Figure 5B:
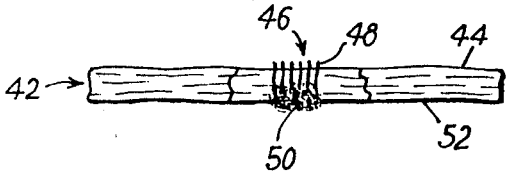

It is found that more attractive decorations is produced if the fibers of the roving are needled through the fabric from the reverse to the face than if they are needled directly into the face of the fabric. This is illustrated in FIGS. 5A and 5B where a base fabric 42 exhibits on its face 44 a decorative stripe 46 composed of differently coloured fibers 48. These fibers are derived from a roving or sliver 50 applied to the reverse 52 of the fabric and needled through in the manner already described until sufficient fibers 46 become visible at the face of the fabric to achieve the desired decorative effect.

Where the apparatus is being used with a garment and it is necessary or more convenient that two layers of the garment be introduced into the working zone, the garment layers may be separated after punching, so that the fibers are attached to one layer only. Preferably, however, a layer of paper or plastic material is sandwiched between the two layers to prevent fibers penetrating to the bottom layer.

The following are examples of the practice of the invention.

EXAMPLE 1

A garment knitted from 2/8's Shetland wool yarn to cover factor 0.8 was decorated with 400 tex contrastingly dyed rovings of 64's quality wool using the apparatus described and shown. The needles used were 15-18-32 RB Type A Kick-up needles with 10 mm penetration and there were ten needles in a 3/2/3/2 staggered array measuring 7.5 mm x 5 mm in the block. The feed dogs were set to move the fabric between 3 and 3.5 mm for each stroke of the needle bar. After the rovings had been needled into the fabric, the latter was milled in a standard 'Cubex' test washing machine for 17 minutes at 40° C. using a standard buffer solution at 15:1 liquor to goods ratio.

The garment so treated had the appearance of a typical Shetland garment structure with attractive patterning effects, and the needled fibers were supported by and blended well with the fabric surface.

EXAMPLE 2

The procedure of Example 1 was repeated using 2 ends of 200 tex woollen slubbings. Again, an attractive patterned garment resulted.

EXAMPLE 3

A fully fashioned garment was knitted to a cover factor of 0.8 from 2/8's dyed Shetland wool yarn. A design was needled onto the front of the garment from the inside, using two colours of untreated 1000 tex worsted roving made from 64's quality top. The garment was then scoured and milled with other garments and makeweights in a rotary milling machine using a typical commercial milling cycle. After rinsing, tumble drying and pressing, it was found that the design had a subtle appearance, the contrasting fibers lying within rather than on top of the fabric.

EXAMPLE 4

A fully fashioned garment was knitted to a cover factor of 0.95 from 2/15's dyed lambswool yarn. It was then needled with a design, scoured and milled as described in Example 3. Again it was found that by needling from the inside, a more subtle effect could be obtained, with the applied fibers blending into the fabric of the garment.

I claim:

1. A method for converting a lockstitch sewing machine to a machine for decorating fabrics of keratinous fibers with at least one untwisted strand of keratinous fiber applied in a pattern to the fabric, comprising the steps: (a.) removing the throat plate, feed dog, presser foot, bobbin, bobbin case and the needle bar from the machine; (b.) attaching to the machine a needle block having means for securing a plurality of needle punching needles therein to the needle mounting of a sewing machine; a throat plate apertured to correspond with the plural needles carried by the needle block; a presser foot apertured to correspond with the spacing of the needles in the needle block for passage of the needles therethrough; the presser foot provided with a guide passage for introduction of a fibrous strand between the throat plate and the presser foot; and a feed dog having sufficient clearance for the needles carried by the needle block.

2. The method as defined in claim 1 further including attaching a roving guide and package mount for the at least one strand of keratinous fibers.

3. The method as defined in claim 2 further including fitting standard needle-punching needles to the needle block.

* * * * *